US008800119B2

(12) United States Patent
Sato

(10) Patent No.: US 8,800,119 B2
(45) Date of Patent: Aug. 12, 2014

(54) SLIDER FOR SLIDE FASTENER AND QUICK OPEN-TYPE SLIDE FASTENER

(75) Inventor: Hideki Sato, Toyama (JP)

(73) Assignee: YKK Corporation (JP)

( * ) Notice: Subject to any disclaimer, the term of this patent is extended or adjusted under 35 U.S.C. 154(b) by 437 days.

(21) Appl. No.: 13/202,629

(22) PCT Filed: Mar. 31, 2009

(86) PCT No.: PCT/JP2009/056690

§ 371 (c)(1),
(2), (4) Date: Aug. 22, 2011

(87) PCT Pub. No.: WO2010/113275

PCT Pub. Date: Oct. 7, 2010

(65) Prior Publication Data

US 2011/0296654 A1 Dec. 8, 2011

(51) Int. Cl.
*A44B 19/26* (2006.01)
*A44B 19/38* (2006.01)

(52) U.S. Cl.
CPC ..... *A44B 19/384* (2013.01); *A44B 19/26* (2013.01)
USPC ..... 24/416; 24/415; 24/427

(58) Field of Classification Search
CPC ..... A44B 19/26; A44B 19/384
USPC ..... 24/415, 416, 417, 427, 428
See application file for complete search history.

(56) References Cited

U.S. PATENT DOCUMENTS 2,495,176 A * 1/1950 Nissen ..... 24/416
2,575,501 A 11/1951 Ulrich
2,590,106 A * 3/1952 Lackritz ..... 24/416
2,596,861 A 5/1952 Meech
2,607,976 A * 8/1952 Zahel ..... 24/416
2,671,258 A * 3/1954 Lackritz ..... 24/416
2,879,573 A 3/1959 Ulrich
3,818,549 A 6/1974 Moertel

FOREIGN PATENT DOCUMENTS

| | | | |
|---|---|---|---|
| DE | 2346962 | A | 4/1974 |
| FR | 2199951 | A | 4/1974 |
| GB | 1394968 | A | 5/1975 |
| JP | 37-32712 | Y1 | 12/1962 |
| JP | 49-70740 | A | 7/1974 |
| JP | 2005-246006 | A | 9/2005 |

OTHER PUBLICATIONS

International Search Report and Written Opinion, PCT International Patent Application No. PCT/JP2009/056690, mailed Jun. 30, 2009.

* cited by examiner

*Primary Examiner* — Robert J Sandy

(74) *Attorney, Agent, or Firm* — Kilpatrick Townsend & Stockton LLP

(57) ABSTRACT

Disclosed is a slider for a slide fastener having a flexible upper wing piece and lower wing piece, and configured in such a way that zipper teeth are thrust into a tape insertion passage when a lateral pulling force is applied to a left and right pair of first and second fastener stringers. Accordingly, the application of a lateral pulling force to the left and right first and second fastener stringers results in the expansion of the width of the tape insertion passage of the slider and the separation of the zipper tooth rows. Thereupon the first and second fastener stringers which are engaged can be readily switched to a disengaged state.

9 Claims, 10 Drawing Sheets

SLIDER FOR SLIDE FASTENER AND QUICK OPEN-TYPE SLIDE FASTENER

This application is a national stage application of PCT/JP2009/056690, which is incorporated herein by reference.

TECHNICAL FIELD

The invention relates to a slider that can quickly open closed left and right fastener stringers without being slid, and a quick open-type slide fastener including the slider.

BACKGROUND ART

A general slide fastener includes a pair of left and right fastener stringers where a plurality of zipper teeth is attached along edges of a pair of left and right fastener tapes facing each other. An upper stop is fixed to one end of a zipper teeth row of the fastener stringer, a lower stop is fixed to the other end thereof, and the zipper teeth rows are inserted into a slider that opens and closes left and right fastener stringers. In general, the slider opens and closes the left and right fastener stringers by being slid along the zipper teeth rows.

There is also known a so-called quick open-type slide fastener that can quickly disengage closed left and right fastener stringers without the sliding of a slider unlike the general slide fastener. In a slide fastener proposed in, for example, Japanese Patent No. 4103088 (Patent Document 1), a slider is divided into two pieces, that is, left and right components and the left and right component are adapted to be capable of being engaged with and disengaged from each other by circular magnets for the purpose of the easy opening of the left and right fastener stringers in a left-right direction.

Further, in a quick open-type slide fastener disclosed in the specification of U.S. Pat. No. 2,575,501 (Patent Document 2), a predetermined number of zipper teeth, which are disposed at the end portion of a zipper teeth row of one fastener stringer corresponding to an upper stop, are excluded and a gap of a tape insertion passage is set to be larger than a general gap so that a portion of a fastener tape where the zipper teeth are excluded is easily separated from the tape insertion passage formed between upper and lower flanges of upper and lower wing pieces of a slider. The reason for this is to prevent a core portion attached to the fastener tape from being caught by the tape insertion passage formed between the upper and lower flanges of the upper and lower wing pieces of the slider in the case of the general gap.

When intending to forcibly disengage the quick open-type slide fastener disclosed in Patent Document 2, a user applies lateral pulling forces to left and right fastener stringers after sliding the slider to the portion where the zipper teeth are excluded. Accordingly, while the slider remains on the other fastener stringer where zipper teeth are not excluded, it is possible to separate the core portion of the fastener tape, where the zipper teeth are excluded, from the slider through a tape insertion passage. Then, it is possible to release the engagement of the zipper teeth row in one stroke. The height of one flange of left and right flange of an upper or lower wing piece of the slider is made low, so that a gap of the tape insertion passage is increased by a constant width.

CITATION LIST

Patent Document

Patent Document 1: Japanese Patent No. 4103088
Patent Document 2: U.S. Pat. No. 2,575,501

DISCLOSURE OF INVENTION

Problem to be Solved by the Invention

In a quick open-type slide fastener disclosed in Patent Document 1, a slider needs to be formed of separate components, that is, the left and right components. Further, since strong magnets should be disposed at the left and right components of the slider, a trouble that the size of the slider is increased occurs. Furthermore, when magnets are disposed at the slider, a magnetic body and the slider are attracted to each other if the magnetic body is positioned near the left and right components while the left and right components of the slider are disengaged from each other. As a result, the operability of the slider deteriorates.

Moreover, since the slider is formed of separate components, that is, the left and right components, the components of the slider are significantly different from components of an existing slider in terms of shape. As a result, a dedicated production line different from an existing production line should be separately prepared in order to produce the quick open-type slide fastener, which causes the increase in the price of products.

Meanwhile, in the quick open-type slide fastener disclosed in Patent Document 2, in order to disengage the engaged zipper teeth rows, a user should perform an operation for opening the left and right fastener stringers in the left-right direction after once sliding the slider to the end portion corresponding to the upper stop. Accordingly, when the slider is positioned at an arbitrary position, it is not possible to perform an operation for instantly opening the slide fastener at the position.

The invention has been made to improve the related arts, and an object of the invention is to provide a quick open-type slide fastener that can instantly open a slide fastener regardless of the position of a slider on the slide fastener and can be produced compact by an existing production facility.

Means for Solving Problem

In order to achieve the above object, there is provided a slider for a slide fastener through which first and second zipper teeth rows attached to edges of a pair of first and second (left and right) fastener stringers facing each other are inserted and which switches the first and second zipper teeth rows to an engaged or disengaged state, the slider including: upper and lower wing pieces; a connection post that is disposed in the middle of left and right shoulder mouths and connects the upper wing piece with the lower wing piece; and a flange that extends from a side edge of at least one of the upper and lower wing pieces toward the opposite wing piece, being characterized in that a tape insertion passage where a fastener tape of each of the first and second fastener stringers is inserted and guided is formed at an end edge of the flange, and at least one of the upper and lower wing pieces is bent, so that the width of the tape insertion passage is increased.

Another invention is characterized in that the flange is formed in an inclined shape where the height of the flange at the shoulder mouth is lower than the height of the flange at a middle portion, and the tape insertion passage is formed in an inclined shape where a gap of the tape insertion passage is gradually increased from the middle portion toward the shoulder mouth.

Another invention is characterized in that the flange is formed in an inclined shape where the height of the flange at a rear mouth is lower than the height of the flange at a middle portion, and the tape insertion passage is formed in an inclined shape where a gap of the tape insertion passage is gradually increased from the middle portion toward the rear mouth.

Another invention is characterized in that a thin portion is formed in a front-rear direction of the slider on a portion of at least one wing piece of the upper and lower wing pieces.

Another invention is a quick open-type slide fastener including: a box pin that is provided at a lower end of a second zipper teeth row disposed at one side edge of a second fastener stringer; and an insert pin that is provided at a lower end of a first zipper teeth row disposed at one side edge of a first fastener stringer and is adapted to be separated from and inserted to the second fastener stringer, being characterized in that the thin portion is formed in a front-rear direction of the slider on a portion of at least one wing piece of the upper and lower wing pieces of the slider corresponding to the first fastener stringer.

Another invention is quick open-type slide fastener including: a box pin that is provided at a lower end of a second zipper teeth row disposed at one side edge of a second fastener stringer; and an insert pin that is provided at a lower end of a first zipper teeth row disposed at one side edge of a first fastener stringer and is adapted to be separated from and inserted to the second fastener stringer, being characterized in that the flange having the inclined shape is formed at a portion of the slider corresponding to the first fastener stringer.

Effect of the Invention

According to the invention, the upper wing piece or the lower wing piece of the slider has flexibility. Accordingly, when lateral pulling forces in the left-right direction are applied to the first and second fastener stringers that come out from the shoulder mouth of the slider of the closed quick open-type slide fastener, the flange is to ride over the zipper teeth. Therefore, the upper or lower wing piece having flexibility is bent and the width of the tape insertion passage is increased, so that the zipper teeth are thrust into the tape insertion passage.

Further, if lateral pulling forces in the left-right direction continue to be applied to the left and right fastener stringers, the zipper teeth bitten into the tape insertion passage are gradually moved toward the rear mouth of the slider while sliding on the apex of the end edge of the flange. Since the upper or lower wing piece of the slider has flexibility, the zipper teeth bitten into the tape insertion passage pass through the tape insertion passage while bending the upper or lower wing piece of the slider in a direction where the width of the tape insertion passage is increased. Accordingly, the zipper teeth positioned in the zipper teeth guide passage of the slider are sequentially separated from the tape insertion passage of which the width is increased, and the zipper teeth row is then completely separated from the slider.

After the zipper teeth row is separated from the slider, it is possible to easily switch engaged zipper teeth rows to a disengaged state by only slightly opening the engaged left and right fastener stringers in the left-right direction.

Moreover, according to another invention, the tape insertion passage is formed in an inclined shape where a gap of the tape insertion passage is gradually increased from the middle portion toward the shoulder mouth. Accordingly, when lateral pulling forces in the left-right direction are applied to the first and second fastener stringers, the flange corresponding to the shoulder mouth of which the height is set to be low is to ride over the zipper teeth. Therefore, the upper or lower wing piece having flexibility is bent and the width of the tape insertion passage is increased, so that the zipper teeth are thrust into the tape insertion passage.

Further, if lateral pulling forces in the left-right direction continue to be applied to the left and right fastener stringers, the zipper teeth bitten into the tape insertion passage are gradually moved toward the rear mouth of the slider while sliding on the apex of the end edge of the flange which is formed in an inclined shape. Since the upper or lower wing piece of the slider has flexibility, the zipper teeth bitten into the tape insertion passage further increase the width of the tape insertion passage while bending the upper or lower wing piece of the slider in a direction where the width of the tape insertion passage is increased. When the width of the tape insertion passage is increased up to the thickness of the zipper tooth, the zipper teeth are sequentially separated through the tape insertion passage of which the width is increased and the zipper teeth row is then completely separated from the slider.

After the zipper teeth row is separated from the zipper teeth guide passage of the slider, it is possible to easily switch engaged zipper teeth rows to a disengaged state by only slightly opening the engaged left and right fastener stringers in the left-right direction.

Furthermore, according to another invention, the tape insertion passage is formed in an inclined shape where a gap of the tape insertion passage is gradually increased from the middle portion toward the rear mouth. Accordingly, when lateral pulling forces are applied to the engaged first and second fastener stringers toward the rear mouth of the slider from a distance and the engaged first and second fastener stringers have been sequentially switched to a disengaged state, the flange corresponding to the rear mouth of which the height is set to be low is to ride over the zipper teeth. Therefore, the upper or lower wing piece having flexibility is bent and the width of the tape insertion passage is increased, so that the zipper teeth are thrust into the tape insertion passage.

Further, if larger lateral pulling forces are applied to the left and right fastener stringers, the zipper teeth bitten into the tape insertion passage are gradually moved toward the shoulder mouth of the slider while sliding on the apex of the end edge of the flange which is formed in an inclined shape. Since the upper or lower wing piece of the slider has flexibility, the zipper teeth bitten into the tape insertion passage further increase the width of the tape insertion passage while bending the upper or lower wing piece of the slider in a direction where the width of the tape insertion passage is increased. When the width of the tape insertion passage is increased up to the thickness of the zipper tooth, the zipper teeth are sequentially separated through the tape insertion passage of which the width is increased and the zipper teeth row is then completely separated from the slider.

Furthermore, according to another invention, the thin portion is formed in a front-rear direction of the slider on a portion of at least one wing piece of the upper and lower wing pieces. Accordingly, when the left and right fastener stringers are to be opened in the left-right direction, it is possible to separate the zipper teeth row, which corresponds to the wing piece including the thin portion, through the tape insertion passage of which the width is increased while always bending the wing piece including the thin portion in a direction where the width is increased. Therefore, it is possible to disengage the left and right fastener stringers while always making the slider remain on a predetermined fastener stringer.

Moreover, according to another invention, a box pin is provided at a lower end of a second fastener stringer, an insert pin is provided at a lower end of a first fastener stringer, and a thin portion is formed on a portion of a wing piece of a first fastener stringer of a slider. Accordingly, when the left and right fastener stringers of the quick open-type slide fastener are to be opened in the left-right direction, it is possible to always separate the zipper teeth row corresponding to the first fastener stringer. Therefore, it is possible to disengage the left and right fastener stringers while always making the slider remain on the second fastener stringer corresponding to the box pin. When a user is to close the disengaged fastener stringers again, a user may slide the slider along the first and second zipper teeth rows after a user inserts the insert pin into the slider and the box while moving down the slider to the position of the box pin, as in the slide fastener including a separable bottom end stop in the related art.

Further, according to another invention, a box pin is provided at a lower end of a second fastener stringer, an insert pin is provided at a lower end of a first fastener stringer, and the flange of the slider corresponding to the first fastener stringer is formed in an inclined shape. Accordingly, when the left and right fastener stringers of the quick open-type slide fastener are to be opened in the left-right direction, it is possible to always separate the zipper teeth row corresponding to the first fastener stringer. Therefore, it is possible to disengage the left and right fastener stringers while always making the slider remain on the second fastener stringer corresponding to the box pin. When a user is to close the disengaged fastener stringers again, a user may slide the slider along the first and second zipper teeth rows after a user inserts the insert pin into the slider and the box while moving down the slider to the position of the box pin, as in the slide fastener including a separable bottom end stop in the related art.

EXPLANATIONS OF LETTERS AND NUMERALS

Figure 1:
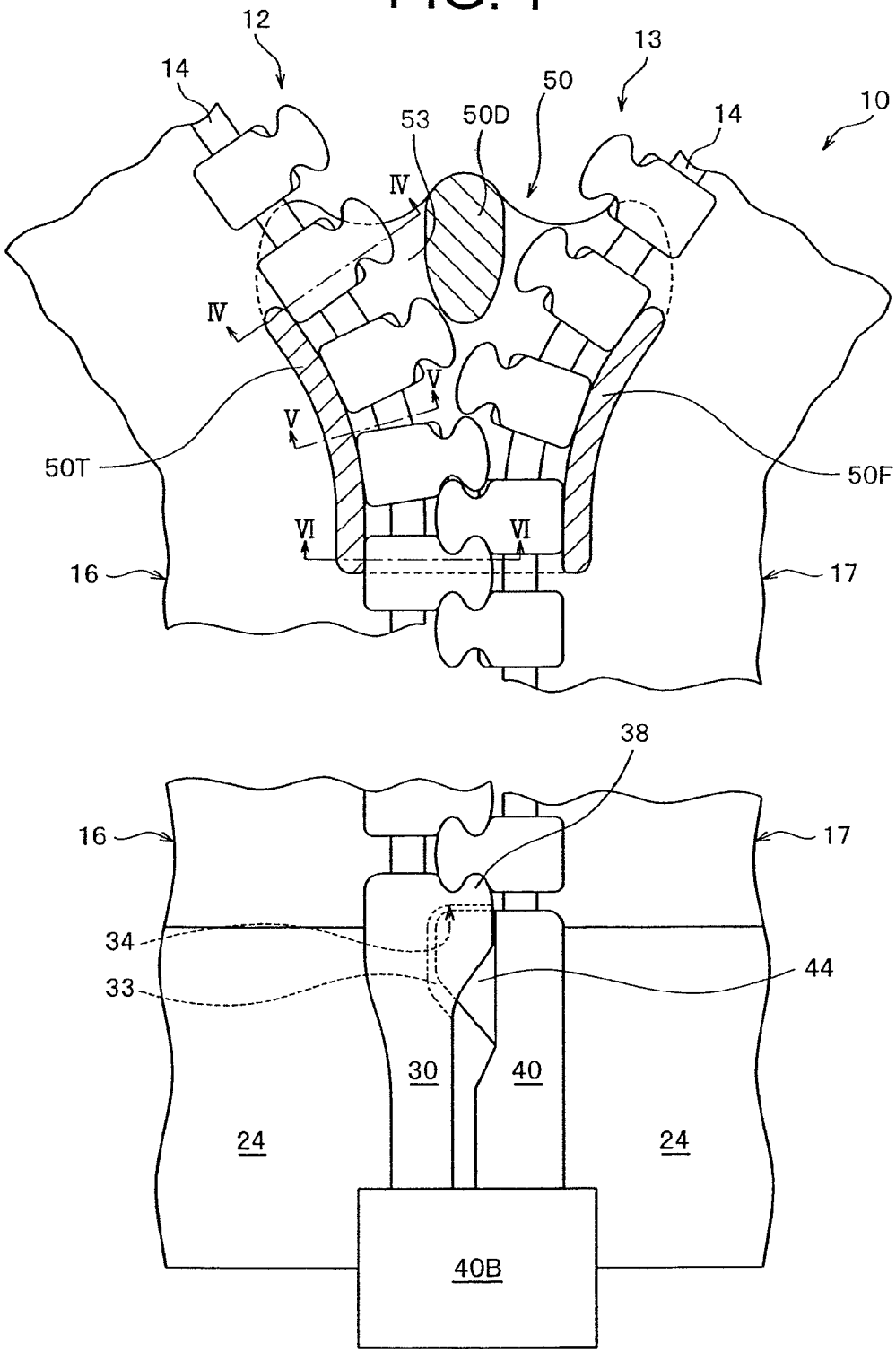
FIG. 1 is a plan view of the entire quick open-type slide fastener.

10: quick open-type slide fastener
12: first zipper teeth row
12-1 to 12-4: first to fourth zipper teeth
13: second zipper teeth row
14: core portion
16: first fastener stringer
17: second fastener stringer
24: reinforcing film
30: insert pin
33: recess
34: first engaging portion
38: engagement protrusion
40: box pin
40B: box
44: second engaging portion
50, 150, 250, 350, 450: slider
50D: connection post
50F, 750F: flange
50T, 150T, 350T, 450T, 550T, 650T: flange
50U, 250U, 350U, 550U, 650U: flange
52: upper wing piece
53: lower wing piece
54: thin portion
55: groove portion
58: pull tab attaching post
59: pull tab
59A: pull tab shaft section

BEST MODE FOR CARRYING OUT THE INVENTION

Typical embodiments of a quick open-type slide fastener according to the invention will be specifically described below with reference to the drawings. FIG. 1 is a plan view of a quick open-type slide fastener 10 with a separable bottom end stop according to this embodiment where an upper wing piece 52 (see FIG. 2) of a slider 50 is not shown. Meanwhile, the separable bottom end stop includes an insert pin 30, a box pin 40, and a box 40B.

As shown in FIG. 1, the quick open-type slide fastener 10, where closed left and right fastener stringers can be opened quickly, is an opening/closing tool that can open and close right and left front body parts of, for example, clothes in common use, emergency clothes that need to be instantly opened, and the like.

The quick open-type slide fastener 10 includes first and second fastener stringers 16 and 17, left and right core portions 14 that are disposed along side edges of the first and second fastener stringers 16 and 17 facing each other, first and second zipper teeth rows 12 and 13 where a plurality of zipper teeth is arranged at predetermined intervals so as to pinch the respective core portions 14, and a slider 50 through which the first and second zipper teeth rows 12 and 13 are inserted and which can open and close the slide fastener 10. Meanwhile, a resin molded product such as polyacetal may be used as the material of each of the zipper teeth of the first and second zipper teeth rows 12 and 13.

A zipper teeth guide passage through which the first and second zipper teeth rows 12 and 13 are inserted in a vertical direction and which is surrounded by flanges 50F and 50T is formed in the slider 50 in a Y shape. Further, a connection post 50D, which connects an upper wing piece 52 (see FIGS. 2 and 3 described below) with a lower wing piece 53, is disposed in the middle of the zipper teeth guide passage corresponding to shoulder mouths (an upper portion of the slider 50 in an embodiment shown in FIG. 1).

Left and right shoulder mouths that are formed on both sides of the connection post 50D disposed at the front end of the slider 50, and a rear mouth that is formed at the rear end of the slider are formed at front and rear ends of the zipper teeth guide passage. The shoulder mouths of the slider 50 lead left and right zipper teeth, which are disengaged from each other, into or from the zipper teeth guide passage, and the rear mouth leads left and right zipper teeth, which are engaged with each other, into or from the zipper teeth guide passage.

When the slider 50 is slid toward an upper stop (not shown) along the first and second zipper teeth rows 12 and 13, the first and second (left and right) zipper teeth rows 12 and 13, which are disengaged from each other, are engaged with each other and come out from the rear mouth of the slider 50. In contrast, when the slider 50 is slid toward the separable bottom end stop, the first and second zipper teeth rows 12 and 13, which are engaged with each other, are led from the rear mouth of the slider 50 and come out from the left and right shoulder mouths after being disengaged from each other.

The insert pin 30 is provided at the lower portion of the first zipper teeth row 12 of the first fastener stringer 16, and the box pin 40 is provided at the lower portion of the second zipper teeth row 13 of the second fastener stringer 17.

The box 40B is fixed to the lower end portion of the box pin 40. It is possible to couple the first (left) fastener stringer 16 with the second (right) fastener stringer 17 by inserting the lower end portion of the insert pin 30 into the box through the slider 50. A hollow portion into which the lower end portion of the insert pin 30 is inserted is formed at the box 40B. Meanwhile, the insert pin 30, the box pin 40, the box 40B form the separable bottom end stop.

The separable bottom end stop, which includes the box 40B at the lower end of the box pin 40, has been used in the quick open-type slide fastener 10 with a separable bottom end stop shown in FIG. 1. However, the invention may also be applied to a side open-type slide fastener that does not use the box 40B, other than the quick open-type slide fastener. Further, in the embodiment shown in FIG. 1, the invention has been applied to the quick open-type slide fastener 10 that can be opened and closed by the sliding of one slider. However, the invention may be applied to a both open-type slide fastener where zipper teeth rows are inserted through two sliders 50 of which rear mouths face each other.

As shown in FIG. 1, a reinforcing film 24, which is formed of a film made of a resin, is attached to each of the front and back of a tape end portion of the first fastener stringer 16 corresponding to the insert pin 30. Further, the insert pin 30 is fixed so as to pinch both the reinforcing film 24 and the core portion 14. Likewise, the reinforcing film 24 is also attached to each of the front and back of a tape end portion of the second fastener stringer 17 corresponding to the box pin. The box pin 40 is fixed so as to pinch both the reinforcing film 24 and the core portion 14.

A second engaging portion 44, which is formed in the shape of a trapezoidal plate, protrudes from the surface of the box pin 40 that faces the insert pin 30 and corresponds to the second zipper teeth row 13. The second engaging portion 44 is a portion that is engaged with a first engaging portion 34 of the insert pin 30 to be described later.

A first engaging portion 34, which is formed of an engaging surface facing the end portion of the insert pin 30, protrudes from the surface of the insert pin 30, which faces the box pin 40, so as to be reinforced by both front and back sidewalls thereof. An engagement protrusion 38, which is engaged with the lowermost zipper tooth of the second zipper teeth row 13, is formed on the upper surface of the first engaging portion 34. The first engaging portion 34 is a portion that positions the insert pin 30 relative to the box pin 40 in a longitudinal direction of the fastener stringer by being engaged with the second engaging portion 44 of the box pin 40 when the insert pin 30 is inserted into the shoulder mouth of the slider 50 while the slider 50 comes into contact with the box 40B after being moved to the lowermost position. A recess 33, which is surrounded by both the sidewalls, is formed at a lower portion of the first engaging portion 34 facing the box 40B. The recess 33 is a portion where the second engaging portion 44 of the box pin 40 enters.

Figure 2:
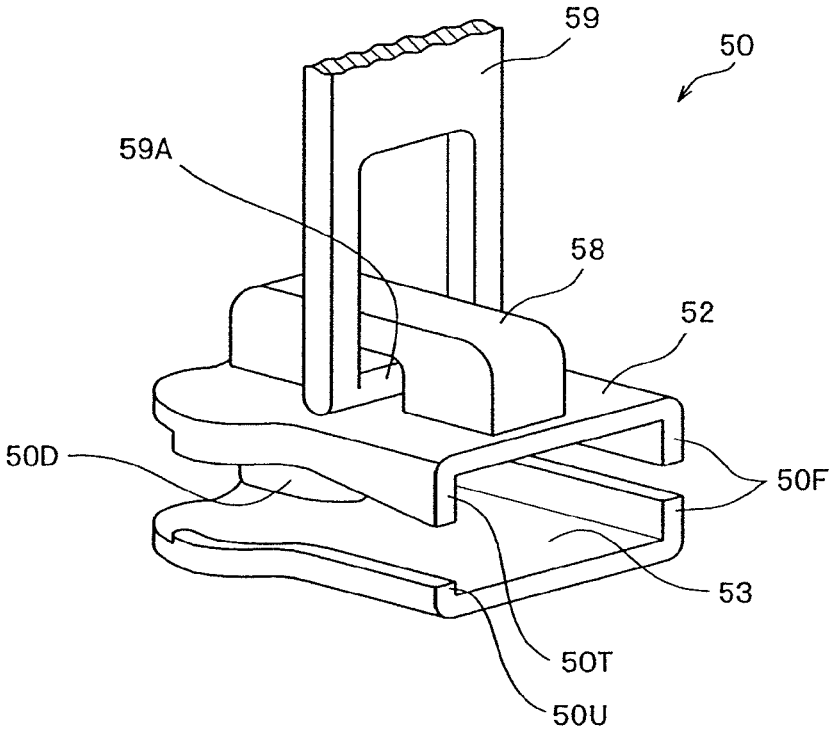
FIG. 2 is a perspective view of a slider when seen from a rear mouth.

Next, the structure of the slider 50 will be described with reference to FIGS. 2 and 3. FIG. 2 is a perspective view of the slider 50 when seen from the rear mouth, and FIG. 3 is a left side view of the slider 50.

Figure 3:
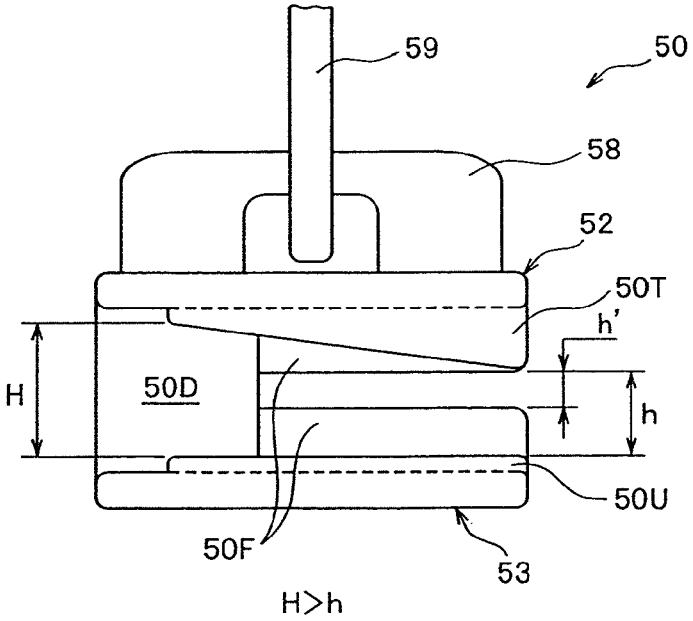
FIG. 3 is a side view of the slider when seen from the left side.

As shown in FIGS. 2 and 3, the upper and lower wing pieces 52 and 53 of the slider 50 are connected to each other by the connection post 50D. The slider 50 includes a slider body, a pull tab 59, and a pull tab attaching post 58. The slider body includes the upper wing piece 52, the lower wing piece 53, and the connection post 50D. The pull tab 59 is a tab that is used to slide the slider body. The pull tab attaching post 58 forms an opening into which a pull tab shaft section 59A serving as the rotational center of the pull tab 59 is rotatably and loosely inserted.

Flanges 50F, 50T, and 50U, which slidably guide the first and second zipper teeth rows 12 and 13 as the slider 50 is moved, extend from both left and right edges of the upper and lower wing pieces 52 and 53 so as to face each other in the vertical direction. A space that is formed between end edges of the respective flanges 50F of the upper and lower wing pieces 52 and 53 facing each other, and a space that is formed between end edges of the flanges 50T and 50U facing each other form tape insertion passages through which fastener tapes of the first and second fastener stringers 16 and 17 are inserted.

The tape insertion passage, which is formed between the end edges of the two (upper and lower) flanges 50F facing each other, is formed to have a constant gap h' between the shoulder mouth and the rear mouth as shown in the side view of FIG. 3. Since this tape insertion passage has a gap where the fastener tape of the second fastener stringer 17 is inserted and guided, the gap h' of the tape insertion passage is set to a distance that is slightly larger than the thickness of the fastener tape, smaller than the thickness of the second zipper teeth row 13, and equal to the gap of a general slider.

The tape insertion passage, which is formed between the end edges of the flanges 50T and 50U facing each other, forms a tape insertion passage where the fastener tape of the first fastener stringer 16 including the insert pin 30 is inserted and guided. The tape insertion passage, which is formed between the end edges of the flanges 50T and 50U facing each other, is formed in an inclined shape where the height of the first flange 50T of the upper wing piece 52 at the shoulder mouth is set to be lower than the height thereof at the middle portion, so that a gap H of the tape insertion passage at the shoulder mouth is set to be larger than a gap h of the tape insertion passage at the rear mouth as shown in the side view of FIG. 3. Meanwhile, in the embodiment shown in FIG. 3, the gap h of the tape insertion passage at the rear mouth has been set to be larger than the gap h' of the tape insertion passage at the first flange 50F. However, according to the flexibility of the upper wing piece 52, the gap h of the tape insertion passage at the rear mouth may be set to be small, that is, may be set up to about the gap h' of the tape insertion passage at the flange 50F.

According to the embodiment shown in FIG. 3, the flange 50U extending from the lower wing piece 53 of the slider 50 is formed to have a low height that is constant between the shoulder mouth and the rear mouth. In contrast to this, the flange 50T extending from the upper wing piece 52 is formed in an inclined shape where the height of the flange at the shoulder mouth is set to be lower than the height thereof at the middle portion. Meanwhile, in another embodiment, in contrast to the embodiment shown in FIG. 3, the flange extending from the upper wing piece 52 may be formed to have a constant height between the shoulder mouth and the rear mouth and the flange extending from the lower wing piece 53 may be formed in an inclined shape where the height of the flange at the shoulder mouth be lower than that at the middle portion.

Figure 4:
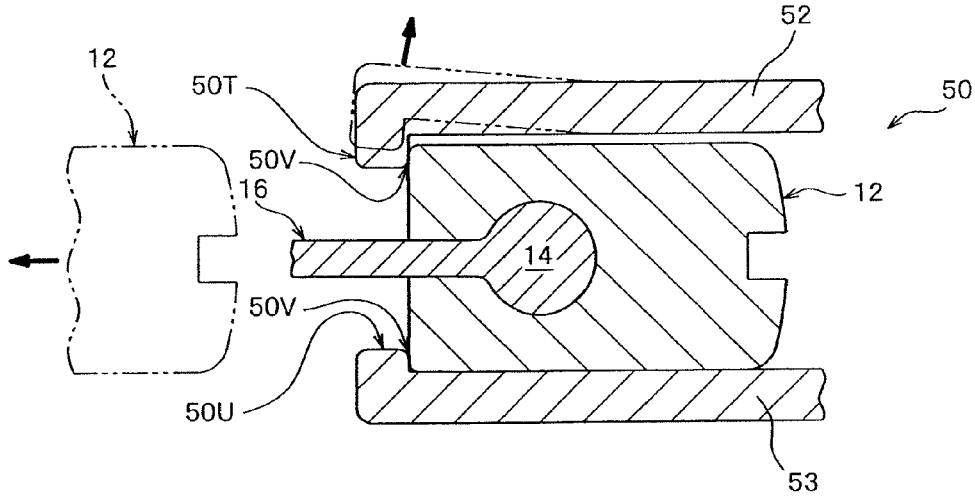
FIG. 4 is a cross-sectional view taken along line IV-IV of FIG. 1.
Figure 5:
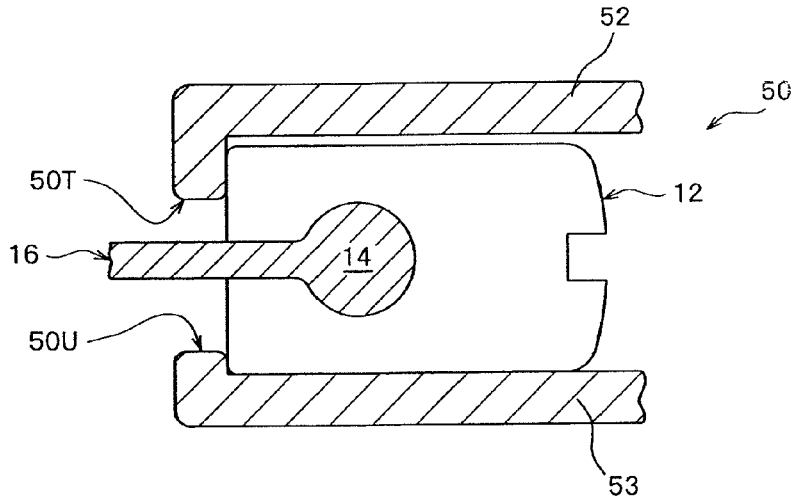
FIG. 5 is a cross-sectional view taken along line V-V of FIG. 1.
Figure 6:
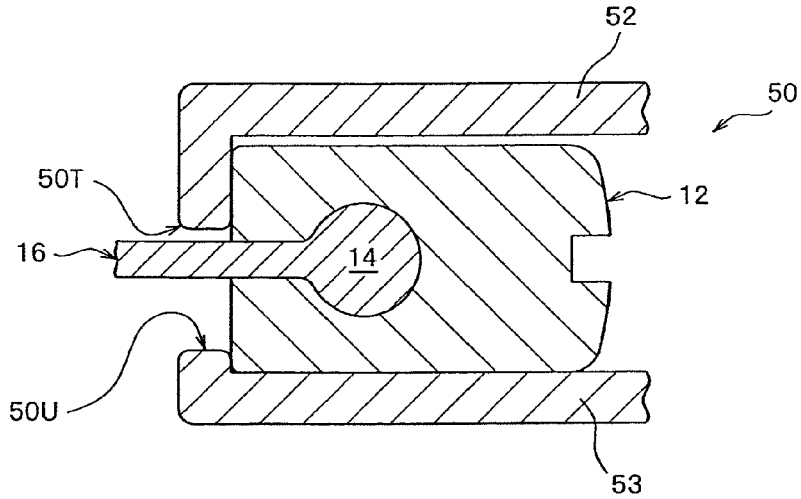
FIG. 6 is a cross-sectional view taken along line VI-VI of FIG. 1.

Next, a situation where the first zipper teeth row 12 and the first fastener stringer 16 are separated from the slider 50 according to this embodiment will be described with reference to FIGS. 4 to 6. FIG. 4 is a cross-sectional view taken along line IV-IV of FIG. 1, and FIG. 5 is a cross-sectional view taken along line V-V of FIG. 1. Further, FIG. 6 is a cross-sectional view taken along line VI-VI of FIG. 1. Meanwhile, the same portions as the portions shown in FIGS. 1 and 2 will be denoted by the same reference numerals and the description thereof will not be repeated.

FIGS. 4 to 6 are cross-sectional views of the first fastener stringer 16 and the zipper teeth guide passage of the slider 50, and are cross-sectional views when seen from the inside of the zipper teeth guide passage toward the shoulder mouth. Since the cross-section shown in FIG. 4 corresponds to a cross-sectional view of a portion of the slider 50 close to the shoulder mouth, the height of a portion of the flange 50T closest to the shoulder mouth is shown so as to be lowest. Since the cross-section shown in FIG. 5 is slightly close to the rear mouth as compared to the position shown in FIG. 4, the height of the flange 50T is shown to be high as compared to the state shown in FIG. 4. Further, since the cross-section shown in FIG. 6 is further close to the rear mouth, the height of the flange 50T is shown to be high as compared to the state shown in FIG. 5.

Since the height of the flange 50T is set to increase toward the middle portion from the shoulder mouth as described above, it is possible to sequentially engage the first and second zipper teeth rows 12 and 13, which are disengaged from each other, by leading the first and second zipper teeth rows 12 and 13 from the shoulder mouths of the slider 50 through the sliding of a general slider 50.

Further, it is preferable that the slider 50 according to this embodiment be formed of a flexible resin molded product such as a crystalline polyamide resin. If the slider 50 is made of a flexible material, it is possible to bend the flange 50T of the upper wing piece 52 of the slider 50 to the outside as shown by a two-dot chain line of FIG. 4. Meanwhile, a polyacetal resin or the like of which hardness is higher than that of the crystalline polyamide resin may be used as the material of each of the first and second zipper teeth rows 12 and 13. The material of each of the slider 50 and the first and second zipper teeth rows 12 and 13 is not limited to the above-mentioned examples. However, the stiffness of at least the wing pieces of the slider 50 may be set to be lower than the stiffness of the first and second zipper teeth rows 12 and 13.

In order to instantly disengage the quick open-type slide fastener 10 according to this embodiment, which are closed, a user applies lateral pulling forces to the first and second fastener stringers 16 and 17 in a left-right direction where the first and second fastener stringers 16 and 17 are opened, when the slider 50 is stopped at an arbitrary position. Accordingly, the zipper tooth of the first zipper teeth row 12 closest to the shoulder mouth enters the tape insertion passage between the flanges 50T and 50U of which the heights are set to be low at the shoulder mouth, and causes a corner of the upper wing piece 52 to be bent upward. As a result, since the width of the tape insertion passage at the shoulder mouth is increased, the first zipper teeth row 12 is bitten into the tape insertion passage. Furthermore, if lateral pulling forces continue to be apply to the first and second (left and right) fastener stringers 16 and 17, the zipper teeth of the first zipper teeth row 12 bitten into the tape insertion passage go over the flanges 50T and 50U and are completely separated from the zipper teeth guide passage of the slider as shown by an imaginary line of FIG. 4.

Moreover, chamfers may be formed at corner portions that are overriding portions 50V where the flanges 50T and 50U and the first zipper teeth row 12 come into contact with each other so that the flanges 50T and 50U easily ride over the first zipper teeth row 12 when lateral pulling forces for opening the first and second (left and right) fastener stringers 16 and 17 in the left-right direction are applied. Further, the same chamfers as the above-mentioned chamfers may be formed at corner portions of the zipper teeth.

Next, the movement of the first zipper teeth row 12, when an operation for quickly opening the left and right fastener stringers, which are closed, is performed without the sliding of the slider, will be described with reference to FIGS. 7 to 10.

Figure 7:
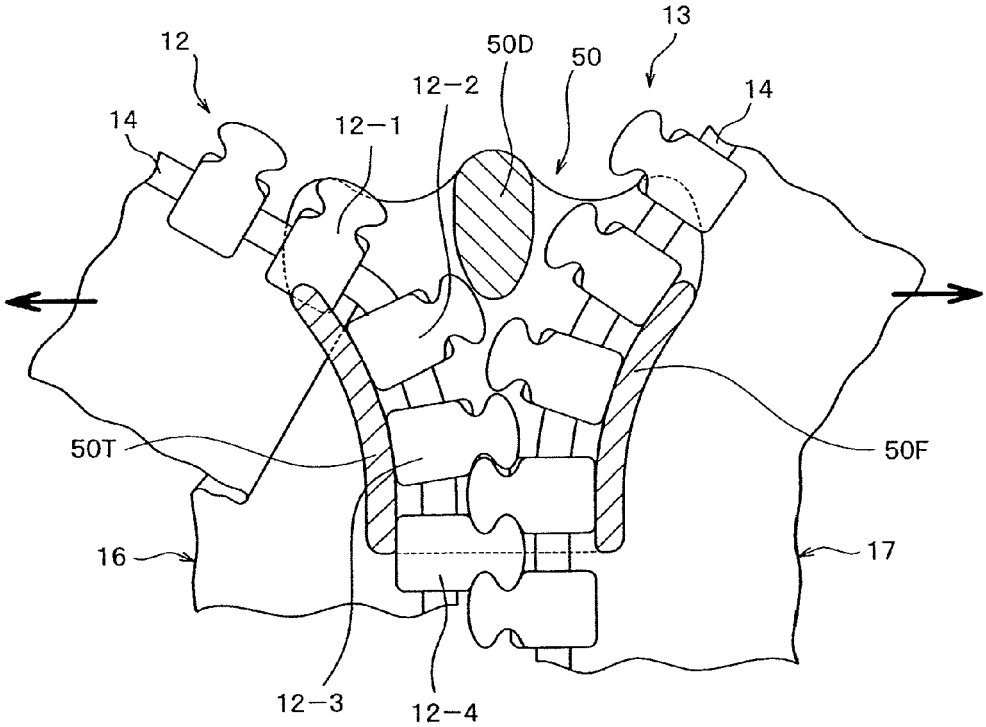
FIG. 7 is a plan cross-sectional view showing a state where the first zipper tooth is bitten into a tape insertion passage facing a flange near a shoulder mouth of the slider.
Figure 8:
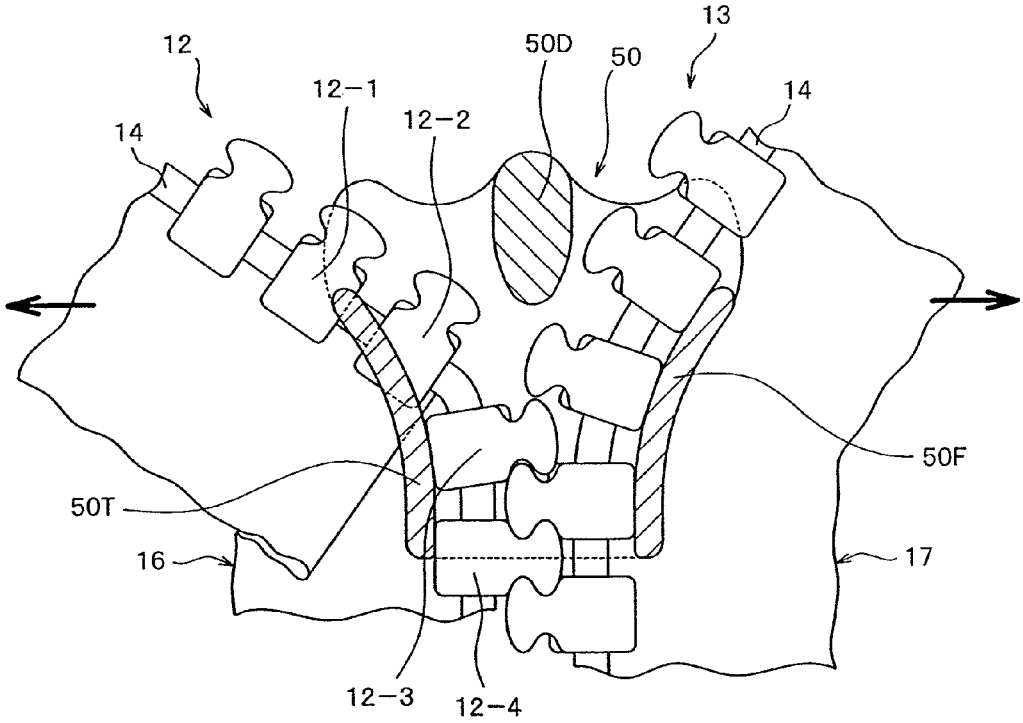
FIG. 8 is a plan cross-sectional view showing a state where a zipper tooth is bitten into the tape insertion passage near the cross-section shown in FIG. 5.
Figure 9:
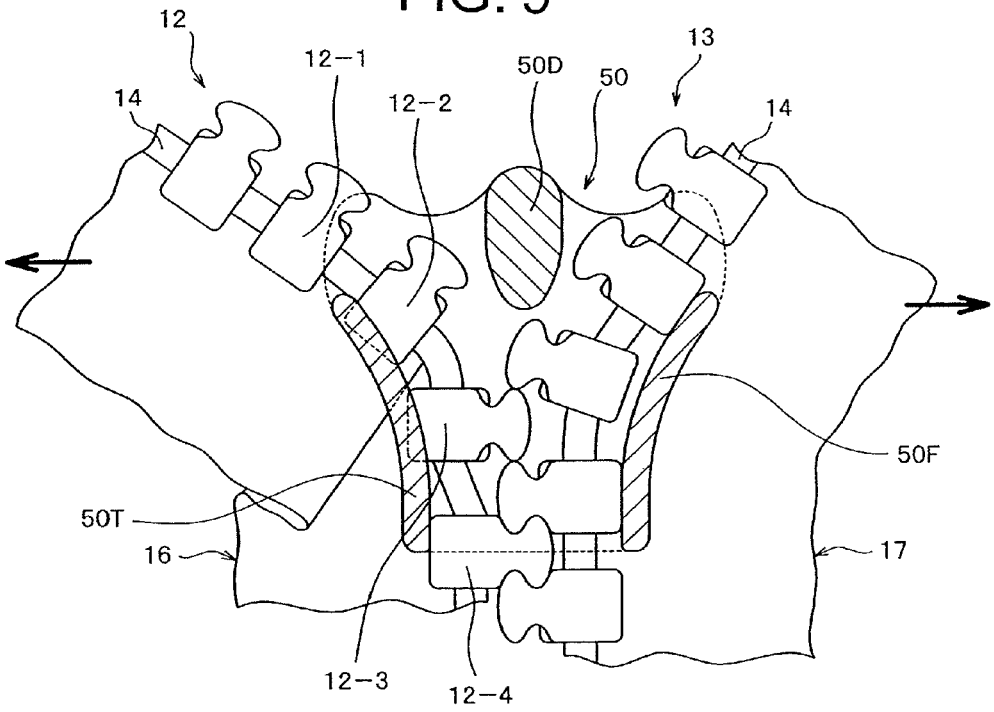
FIG. 9 is a view showing a state where another one of engaged zipper teeth is disengaged from the state shown in FIG. 8 and the disengaged zipper tooth is newly bitten into the tape insertion passage.
Figure 10:
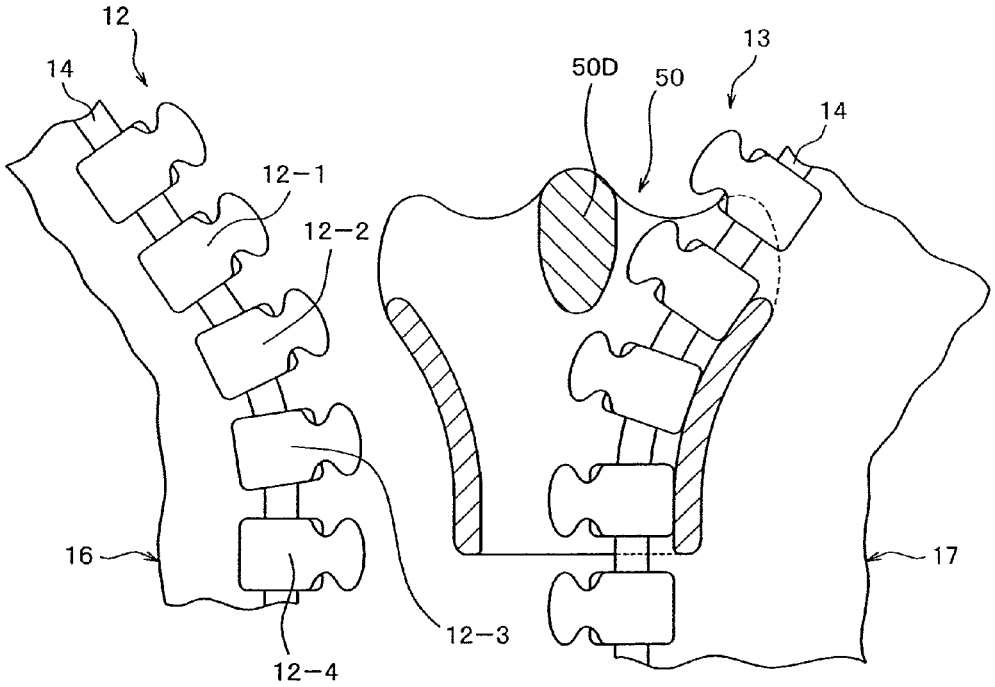
FIG. 10 is a view showing a state where all zipper teeth of a first zipper teeth row are separated from the slider and left and right fastener stringers are disengaged form each other.

FIG. 7 shows a state where a first zipper tooth 12-1 of the first zipper teeth row 12, which is positioned in the zipper teeth guide passage of the slider 50 and closest to the shoulder mouth, is bitten into the tape insertion passage between the end edges of the flanges 50T and 50U facing each other. Further, FIG. 8 shows a state where a second zipper tooth 12-2 is bitten into the tape insertion passage. FIG. 9 is a view showing a state where a third zipper tooth 12-3 which is engaged is disengaged from the state shown in FIG. 8 and the disengaged zipper tooth is newly bitten into the tape insertion passage. FIG. 10 shows a state where all the zipper teeth 12-1 to 12-4 entering the zipper teeth guide passage of the slider 50 are separated and the first and second (left and right) fastener stringers 16 and 17 are disengaged form each other.

There will be described a case where, for example, the first fastener stringer 16 is sewn to the middle edge of a left front body part of clothes, the second fastener stringer 17 is sewn to the middle edge of a right front body part, and the first and second (left and right) fastener stringers 16 and 17 are to be disengaged from each other in one stroke from a state where the first and second zipper teeth rows 12 and 13 are engaged with each other.

First, the first and second zipper teeth rows 12 and 13 are engaged with each other. Further, while the slider 50 is stopped, lateral pulling forces for opening the first and second (left and right) fastener stringers 16 and 17 which come out from the shoulder mouth of the slider 50 in the left-right direction are applied to the first and second fastener stringers as shown in FIG. 7 by arrows.

Accordingly, as shown in FIG. 7, the first zipper tooth 12-1 of the first fastener stringer 16, which is positioned closest to the shoulder mouth of the slider 50, is initially bitten into the tape insertion passage formed between the flanges 50T and 50U. In this case, the corner portion of the flexible upper wing piece 52 at the shoulder mouth is bent upward as shown in FIG. 4 by an imaginary line, so that the width of the tape insertion passage is increased.

If the first and second (left and right) fastener stringers 16 and 17 continue to be further opened in the left-right direction from the state shown in FIG. 7, the bitten zipper teeth 12-1 further increases the width of the tape insertion passage, so that the upper wing piece 52 is further bent. Accordingly, as shown in FIG. 8, the adjacent second zipper tooth 12-2 is bitten into the tape insertion passage of which the width between the flanges 50T and 50U is increased.

If lateral pulling forces continue to be applied from the state shown in FIG. 8 so that the first and second (left and right) fastener stringers 16 and 17 are further opened in the left-right direction, the third zipper tooth 12-3 of the zipper teeth engaged with the second zipper teeth row 13 is disengaged and separated from the second zipper teeth row 13 as shown in FIG. 9. If lateral pulling forces continue to be further applied at this time, a part of the third zipper tooth 12-3 of the first zipper teeth row 12 is bitten into the tape insertion passage between the flanges 50T and 50U.

From the state shown in FIG. 9, if lateral pulling forces continue to be further applied to the first and second (left and right) fastener stringers 16 and 17, the third zipper tooth 12-3 further widens the gap of the tape insertion passage. These are sequentially performed, so that the plurality of zipper teeth 12-1 to 12-4 positioned in the zipper teeth guide passage of the slider 50 sequentially passes through the tape insertion passage from the shoulder mouth and the first zipper teeth row 12 is finally separated from the zipper teeth guide passage of the slider 50. When the first zipper teeth row 12 is separated from the zipper teeth guide passage of the slider 50, the bending (elastic deformation) of the upper wing piece 52 into which the zipper teeth are thrust returns and the upper wing piece returns to the original shape (the position shown by a solid line of FIG. 4).

When the first zipper teeth row 12 is completely separated from the slider, the first and second zipper teeth rows 12 and 13, which come out from the rear mouth of the slider 50 and are engaged with each other, are sequentially disengaged from each other from an upper stop and then disengaged from each other as shown in FIG. 10 even though particular lateral pulling forces are not applied to the first and second zipper teeth rows 12 and 13. Further, as the first and second (left and right) zipper teeth rows 12 and 13 are further disengaged from each other, the insert pin 30 shown in FIG. 1 is separated from the box 40B, so that the first and second (left and right) fastener stringers 16 and 17 are completely disengaged from each other.

A case where the first and second (left and right) fastener stringers 16 and 17, which have been completely disengaged from each other once, are engaged with each other again will be described below. First, a user moves down the slider 50 to the position of the box 40B of the separable bottom end stop of the second fastener stringer 17, and makes the rear mouth of the slider 50 come into contact with the upper surface of the box 40B.

Next, the user inserts the insert pin 30 of the first fastener stringer 16 from the shoulder mouth of the slider 50, and pushes the insert pin down until the lower end portion of the insert pin 30 is inserted into an insert pin-insertion space of the box 40B. When the lower end portion of the insert pin 30 is inserted into the insert pin-insertion space of the box 40B, the second engaging portion 44 of the box pin 40 enters the recess 33 of the insert pin 30 and is positioned in the vertical direction. If the user slides the slider 50 toward the upper stop while the insert pin 30 is engaged with the box pin 40, the first and second zipper teeth rows 12 and 13 are engaged with each other. Accordingly, it is possible to close the left and right front body parts of clothes and to couple both the front body parts.

Next, sliders for slide fasteners according to other embodiments of the invention will be described with reference to FIGS. 11 to 16. FIGS. 11 to 14 and FIG. 16 are left side views similar to FIG. 3. FIG. 15 is a back view of a slider 450 shown in FIG. 14 when seen from a rear mouth. Meanwhile, portions having the same functions as the functions of the portions shown in FIG. 3 will be denoted by the same reference numerals and the description thereof will not be repeated.

In the embodiment shown in FIG. 3, the flange 50U extending from the lower wing piece 53 of the slider 50 is formed to have a low height that is constant between the shoulder mouth and the rear mouth. Further, the flange 50T extending from the upper wing piece 52 is formed in an inclined shape where the height of the flange at the shoulder mouth is set to be lower than the height thereof at the middle portion. Meanwhile, since any one of upper and lower wing pieces 52 and 53 of each of sliders 150, 250, 350, and 450 has flexibility even in embodiment shown in the drawings, it is possible to increase the width of a tape insertion passage by bending an upper wing piece 52 or a lower wing piece 53.

Figure 11:
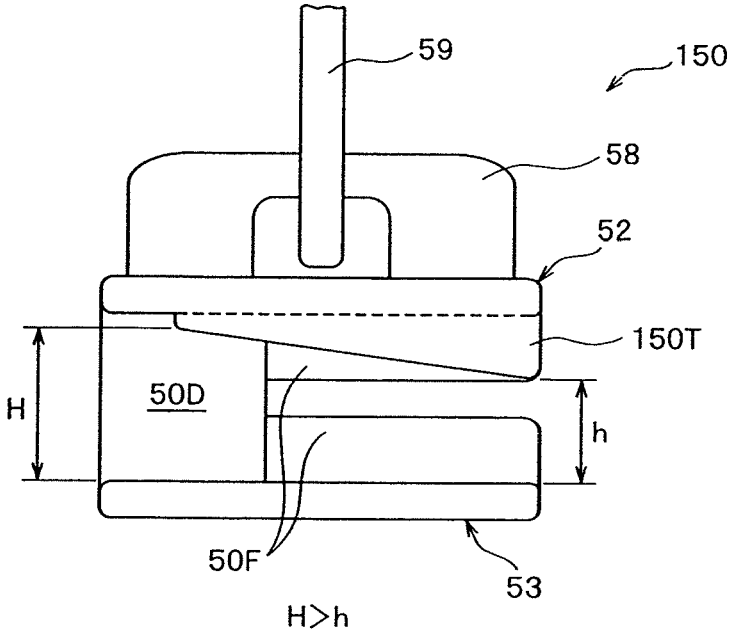
FIG. 11 is a left side view illustrating a tape insertion passage of a slider according to another embodiment.

In an embodiment shown in FIG. 11, the end edge of a flange 150T, which extends from the upper wing piece 52 of the slider 150, facing the lower wing piece 53 is formed in an inclined shape where the height of the flange at the shoulder mouth is set to be lower than the height thereof at the middle portion. Further, a flange does not extend from the lower wing piece 53. Accordingly, a gap H of the tape insertion passage at the shoulder mouth is set to be large and a gap h of the tape insertion passage at the rear mouth is set to be small.

Figure 12:
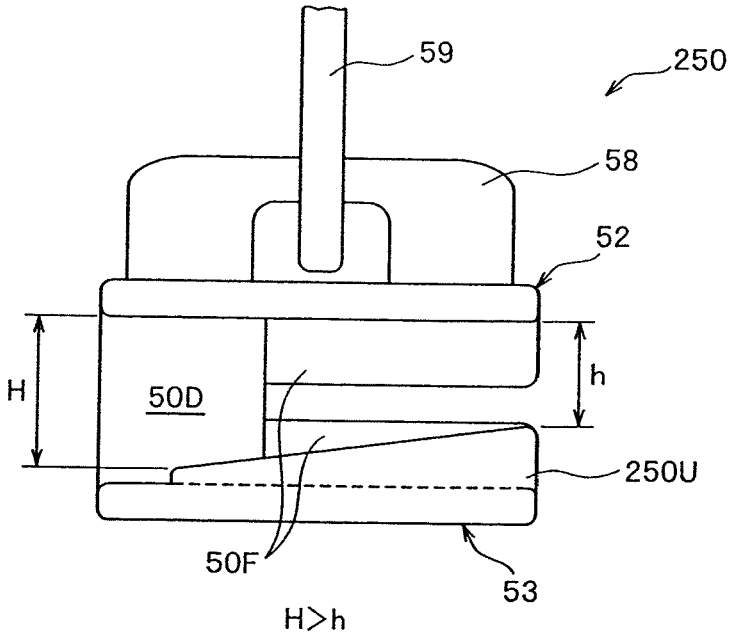
FIG. 12 is a left side view illustrating a tape insertion passage of a slider according to another embodiment.

Furthermore, in an embodiment shown in FIG. 12, in contrast to the embodiment shown in FIG. 11, a flange does not extend from the upper wing piece 52 of the slider 250 and a flange 250U extends from the lower wing piece 53. The flange 250U is formed in an inclined shape where the height of the flange at the shoulder mouth is set to be lower than the height thereof at the middle portion. Accordingly, in this state, a gap H of the tape insertion passage at the shoulder mouth is set to be large and a gap h of the tape insertion passage at the rear mouth is set to be small.

Figure 13:
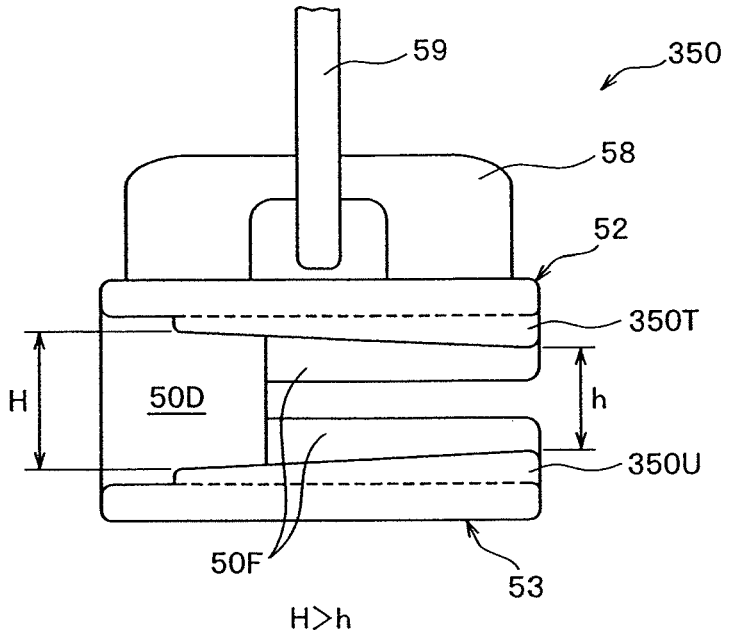
FIG. 13 is a left side view illustrating a tape insertion passage of a slider according to another embodiment.

Moreover, in an embodiment shown in FIG. 13, unlike the embodiments shown in FIGS. 11 and 12, flanges 350T and 350U extend from both the upper and lower wing pieces 52 and 53 of a slider 350, respectively. Further, each of the flanges 350T and 350U is formed in an inclined shape where the height of the flange at the shoulder mouth is set to be lower than the height thereof at the middle portion. As a result, a gap H of the tape insertion passage at the shoulder mouth is set to be large and a gap h of the tape insertion passage at the rear mouth is set to be small.

Figure 14:
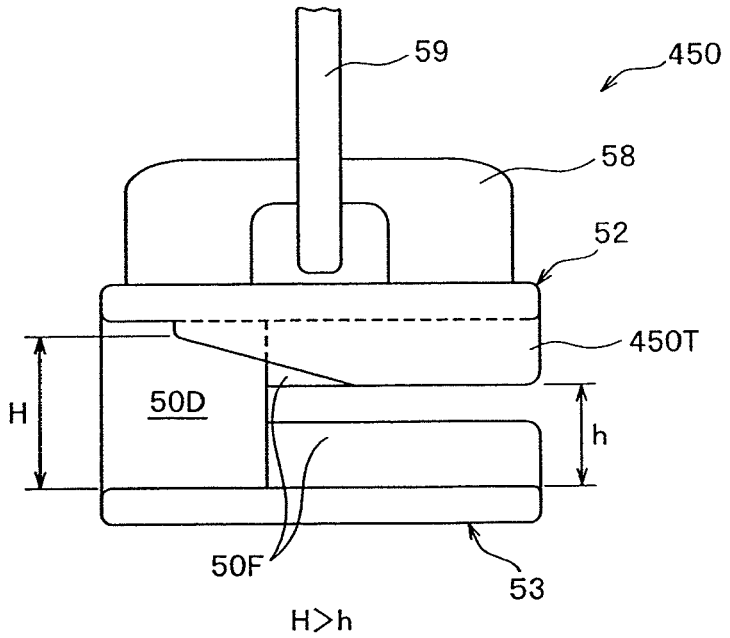
FIG. 14 is a left side view illustrating a tape insertion passage of a slider according to another embodiment.
Figure 15:
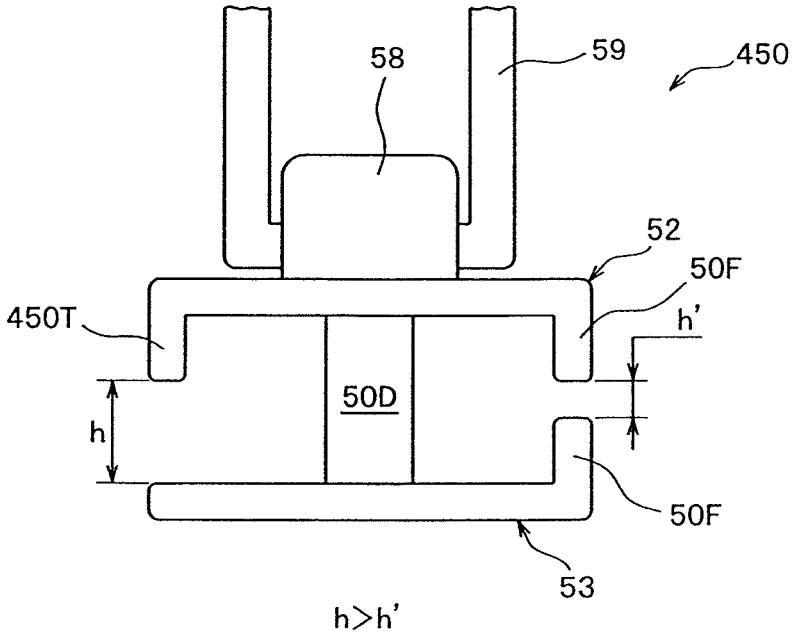
FIG. 15 is a view of the slider shown in FIG. 14 when seen from a rear mouth.

Furthermore, as shown in FIGS. 14 and 15, a part of a flange 450T is formed in an inclined shape where the height of the flange at the shoulder mouth is set to be lower than the height thereof at the middle portion, and the other part of the flange is formed parallel to the upper wing piece 52. Meanwhile, even in the embodiment shown in FIG. 14, a gap H of the tape insertion passage at the shoulder mouth is set to be large and a gap h of the tape insertion passage at the rear mouth is set to be small.

As shown in FIG. 15, a tape insertion passage, which is a space between end edges of two (upper and lower) flanges 50F facing each other, is formed to have a constant gap h' between the shoulder mouth and the rear mouth. Meanwhile, it is preferable that a gap h of the tape insertion passage, which has the inclined shape, at the rear mouth be set to be larger than a gap h' of the opposite tape insertion passage formed parallel to the above-described tape insertion passage in order to make zipper teeth be necessarily separated from a portion of the tape insertion passage having the inclined shape when lateral pulling forces for opening first and second (left and right) fastener stringers (not shown) in the left-right direction are applied.

Figure 16:
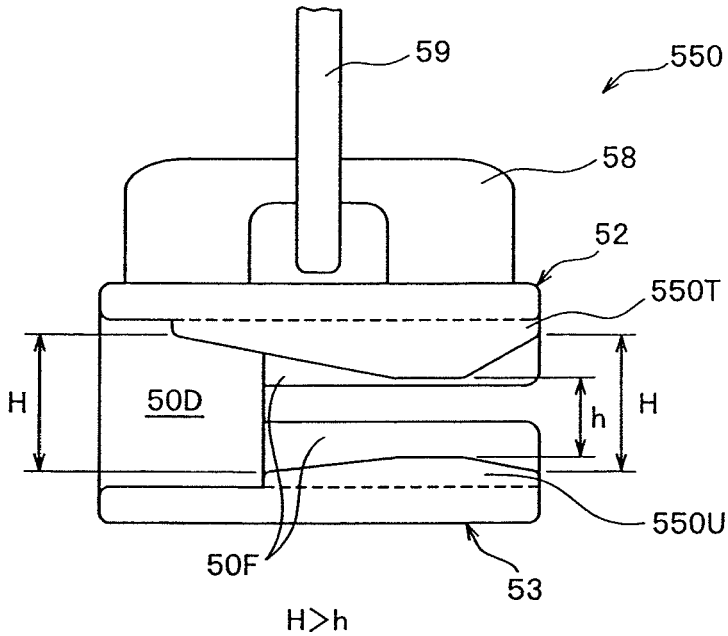
FIG. 16 is a left side view illustrating a tape insertion passage of a slider according to another embodiment.

Moreover, as shown in FIG. 16, there may be used flanges 550U and 550T each of which has both an inclined shape where the height of a flange at the shoulder mouth is lower than the height thereof at the middle portion and an inclined shape where the height of a flange at the rear mouth is lower than the height thereof at the middle portion. Meanwhile, in the embodiment shown in FIG. 16, a gap H of the tape insertion passage at the shoulder mouth of a slider 550 and a gap H of the tape insertion passage at the rear mouth are set to be large and a gap h of the tape insertion passage at the middle portion is set to be small.

If each of the height of the flange at the shoulder mouth of the slider 550 and the height of the flange at the rear mouth is set to be lower than the height of the flange at the middle portion as shown in FIG. 16 and each of the flanges is formed in an inclined shape at the shoulder mouth and the rear mouth, it is possible to separate the zipper teeth row from the slider by increasing the width of the tape insertion passage at the shoulder mouth and the rear mouth. The slider 550 may be used for disengagement of a slide fastener where a plurality of sliders 550 is disposed by tail alignment or head alignment.

Even though the slider is formed as shown in FIGS. 11 to 16, it is possible to separate the zipper teeth rows, which are engaged with each other, from the tape insertion passage by applying lateral pulling forces to the left and right fastener stringers in the left-right direction as described above. Therefore, it is possible to instantly switch the left and right fastener stringers to a disengaged state. Meanwhile, in each of the embodiments shown in FIG. 3 and FIGS. 11 to 14, the flange has been formed in the inclined shape where the height of the flange at the shoulder mouth is set to be lower than the height thereof at the middle portion. However, in contrast to this, a flange may be formed in an inclined shape where the height of the flange at the rear mouth is set to be lower than the height thereof at the middle portion. If a flange is formed in an inclined shape where the height of the flange at the rear mouth is set to be lower than the height thereof at the middle portion, it is possible to separate the zipper teeth row from the slider by increasing the width of the tape insertion passage from the rear mouth.

Figure 17:
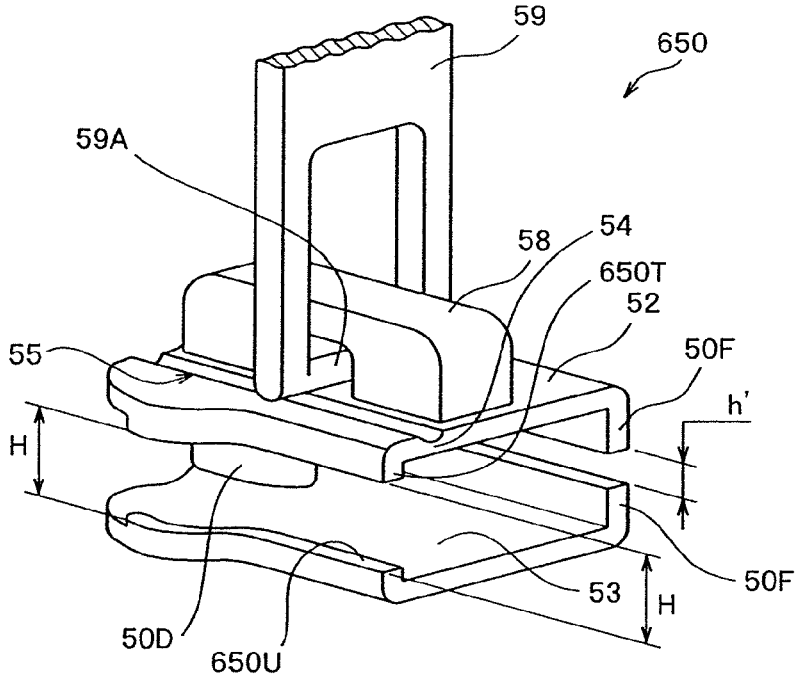
FIG. 17 is a perspective view of a slider where a thin portion is formed at an upper wing piece to obtain flexibility, when seen from a rear mouth.
Figure 18:
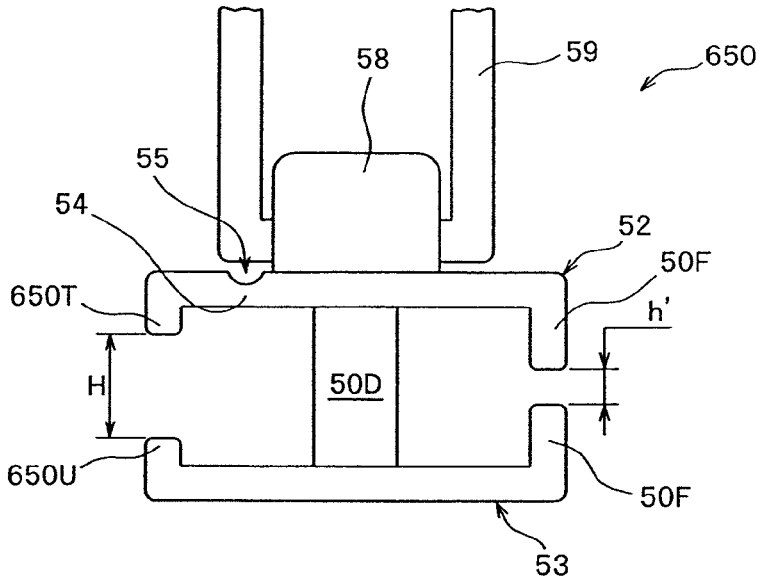
FIG. 18 is a view of the slider shown in FIG. 17 when seen from the rear mouth.
Figure 19:
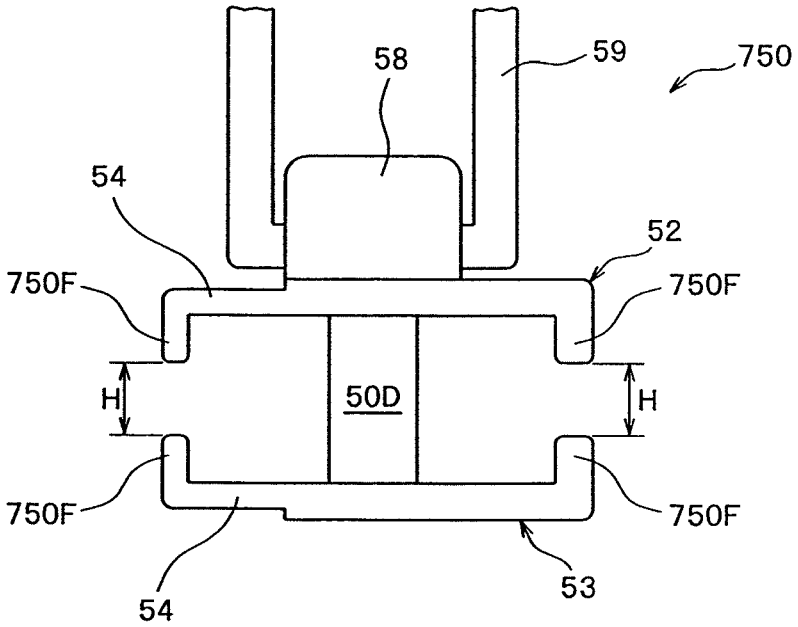
FIG. 19 is a view of a slider where thin portions are formed at both upper and lower wing pieces to obtain flexibility, when seen from a rear mouth.

Next, a slider according to an embodiment, which can increase the width of a tape insertion passage by making at least one of upper and lower wing pieces be bent, will be described with reference to FIGS. 17 to 19. FIG. 17 is a perspective view of a slider 650 where a thin portion 54 is formed at an upper wing piece 52 to obtain flexibility, when seen from a rear mouth. Further, FIG. 18 is a view of the slider 650 shown in FIG. 17 when seen from the rear mouth. FIG. 19 is a view of a slider 750 where thin portions are formed at both upper and lower wing pieces 52 and 53 to obtain flexibility, when seen from a rear mouth. Meanwhile, portions having the same functions as the functions of the portions shown in FIGS. 2, 15, and the like will be denoted by the same reference numerals and the description thereof will not be repeated.

A groove portion 55 is formed in the front-rear direction of the slider 650 on an upper surface of a portion, which corresponds to a left wing, of the upper wing piece 52 of the slider 650 shown in FIGS. 17 and 18. Since the back side of the upper wing piece opposite to the groove portion 55 (the side of the upper wing piece facing a zipper teeth guide passage) is formed in a flat shape, a thin portion 54 is formed at the bottom of the groove portion 55. Since the thin portion 54 is formed at the upper wing piece 52 in the front-rear direction of the slider 650 as described above, a portion of the flange 650T of the upper wing piece 52 is easily bent upward about the thin portion 54 serving as a supporting point. Since the flange 650T is adapted to be easily bent upward, it is possible to increase the width of the tape insertion passage of the slider 650 and to separate the zipper teeth row from the zipper teeth guide passage.

Meanwhile, in the embodiment shown in FIGS. 17 and 18, the height of each of flanges 650U and 650T is set to be lower than that of each of flanges 50F for the purpose of easy separation of the zipper teeth row, so that a gap H is set to be larger than a gap h' between the flanges 50F.

Further, in the embodiment shown in FIGS. 17 and 18, the gap H of the tape insertion passage has been set to be constant between the shoulder mouth and the rear mouth. However, as shown in FIGS. 11 to 16, the gap of the tape insertion passage may be formed in an inclined shape so that the gap H of the tape insertion passage at the shoulder mouth or the rear mouth is set to be large and is reduced toward the middle portion. Furthermore, it may be possible to form a slide fastener with a separable bottom end stop by providing an insert pin at the lower portion of the first zipper teeth row of the first fastener stringer of the slide fastener and providing a box pin and a box at the lower portion of the second zipper teeth row of the second fastener stringer as shown in FIG. 1.

Moreover, in the embodiment shown in FIGS. 17 and 18, the groove portion 55 has been formed on the upper surface of a left portion of the upper wing piece 52, so that the thin portion 54 has been formed at the bottom of the groove portion 55. However, the invention is not limited to this embodiment, and it may be possible to form a structure, which can increase the width of a tape insertion passage, by forming the groove portion 55 and the thin portion 54 at a portion of the upper wing piece 52 corresponding to a left wing, portions of the upper wing piece 52 corresponding to both left and right wings, portion or portions of the lower wing piece 53 corresponding to one wing or both wings, or both the lower wing pieces 52 and 53.

Further, it may be possible to form a thin portion 54 at an upper portion of the upper wing piece 52 by forming a groove portion 55 on the side of the upper wing piece facing a zipper teeth guide passage. Furthermore, it may be possible to form a thin portion at a middle portion of the upper wing piece 52 by forming groove portions on both the upper side of the upper wing piece 52 and the side of the upper wing piece facing the zipper teeth guide passage. Likewise, it may be possible to form a thin portion at a middle portion of the lower wing piece 53 by forming groove portions on both the lower side of the lower wing piece 53 and the side of the lower wing piece facing the zipper teeth guide passage.

Next, an embodiment where thin portions 54 are formed at both upper and lower wing pieces 52 and 53 of a slider 750 will be described with reference to FIG. 19. In the embodiments shown in FIGS. 17 and 18, the groove portion 55 has been formed at the upper wing piece in the front-rear direction of the slider 650, so that the thin portion 54 has been formed at the bottom of the groove portion 55. In contrast to this, as shown in FIG. 19, thin portions 54 may be formed in the front-rear direction and the left-right direction of the slider 750.

If the thin portions 54 are formed in the front-rear direction and the left-right direction of the slider 750 as described above, it is possible to make the upper and lower wing pieces 52 and 53 be easily bent when lateral pulling forces are applied to left and right fastener stringers. Further, it is possible to separate a zipper teeth row from a zipper teeth guide passage by increasing the width of a tape insertion passage.

Meanwhile, in the embodiment shown in FIG. 19, the zipper teeth row has been made to be easily separated from the zipper teeth guide passage by setting the heights of all flanges 750F to the same height. However, as shown in FIGS. 11 to 16, the flanges may be formed in an inclined shape so that the gap H of the tape insertion passage at the shoulder mouth or the rear mouth is set to be large and is reduced toward the middle portion. Moreover, as shown in FIG. 1, it may be possible to form a slide fastener with a separable bottom end stop by providing an insert pin at the lower portion of the first zipper teeth row of a first fastener stringer of the slide fastener and providing a box pin and a box at the lower portion of the second zipper teeth row of the second fastener stringer.

In the embodiment shown in FIG. 19, the thin portions 54 have been formed at the left portions of the upper and lower wing pieces 52 and 53. However, the invention is not limited to this embodiment, and the thin portion 54 may be formed at any one of the upper and lower wing pieces 52 and 53. Further, it may be possible to make the width of the tape insertion passage be capable of being increased by forming thin portions 54 at both left and right portions of the upper wing piece 52 or both sides of the lower wing piece 53.

INDUSTRIAL APPLICABILITY

A quick open-type slide fasteners have been described using embodiments where injection-molded products made of a resin are used as a slider and zipper teeth. However, the zipper teeth and the slider according to the invention are not limited to the injection-molded products made of a resin, and, for example, metal may be used as the material of the zipper tooth.

The invention claimed is:

1. A slider for a slide fastener through which first and second zipper teeth rows attached to edges of a pair of first and second fastener stringers facing each other are inserted and which switches the first and second zipper teeth rows to an engaged or disengaged state, the slider comprising:

upper and lower wing pieces;

a connection post that is disposed between first and second shoulder mouths and connects the upper wing piece with the lower wing piece; and a flange that extends from a first side edge of at least one of the upper and lower wing pieces, wherein a first tape insertion passage where a fastener tape of the first fastener stringer is inserted and guided is formed at an end edge of the flange, wherein a zipper teeth guide passage through which the first and second zipper teeth rows are inserted is formed in the slider, wherein the slider is configured so that when the first fastener stringer and the second fastener stringer are in an engaged state and lateral pulling forces in a left-right direction are applied to the first fastener stringer and the second fastener stringer near the first and second shoulder mouths, zipper teeth of the first zipper teeth row are bitten into the first tape insertion passage, and a width of the first tape insertion passage increases and at least a portion of one of the upper and lower wing pieces is bent outwards, so that the zipper teeth of the first zipper teeth row exit the zipper teeth guide passage across the end edge of the flange.

2. The slider for a slide fastener according to claim 1, wherein the flange is formed in an inclined shape where a height of the flange at the first shoulder mouth is lower than the height of the flange at a middle portion of the flange, and the first tape insertion passage is formed in an inclined shape where a gap of the first tape insertion passage is gradually increased from the middle portion toward the first shoulder mouth.

3. A quick open-type slide fastener comprising:

the slider for a slide fastener according to claim 2;

a box pin that is provided at a lower end of the second zipper teeth row disposed at the edge of the second fastener stringer; and an insert pin that is provided at a lower end of the first zipper teeth row disposed at the edge of the first fastener stringer and is adapted to be separated from and inserted to a box of the second fastener stringer, wherein the flange having the inclined shape is formed at a portion of the slider corresponding to the first fastener stringer.

4. The slider for a slide fastener according to claim 1, wherein the flange is formed in an inclined shape where a height of the flange at a rear mouth is lower than the height of the flange at a middle portion, and the first tape insertion passage is formed in an inclined shape where a gap of the first tape insertion passage is gradually increased from the middle portion toward the rear mouth.

5. A quick open-type slide fastener comprising:

the slider for a slide fastener according to claim 4;

a box pin that is provided at a lower end of the second zipper teeth row disposed at the edge of the second fastener stringer; and an insert pin that is provided at a lower end of the first zipper teeth row disposed at the edge of the first fastener stringer and is adapted to be separated from and inserted to a box of the second fastener stringer, wherein the flange having the inclined shape is formed at a portion of the slider corresponding to the first fastener stringer.

6. The slider for a slide fastener according to claim 1, wherein a thin portion is formed in a front-rear direction of the slider on a portion of at least one of the upper and lower wing pieces.

7. A quick open-type slide fastener comprising:

the slider for a slide fastener according to claim 6;

a box pin that is provided at a lower end of the second zipper teeth row disposed at the edge of the second fastener stringer; and an insert pin that is provided at a lower end of the first zipper teeth row disposed at the edge of the first fastener stringer and is adapted to be separated from and inserted to a box of the second fastener stringer, wherein the thin portion is formed in a front-rear direction of the slider on a portion of at least one of the upper and lower wing pieces of the slider corresponding to the first fastener stringer.

8. The slider for a slide fastener according to claim 1, wherein the first tape insertion passage is larger than a second tape insertion passage where a fastener tape of the second fastener stringer is guided.

9. The slider for a slide fastener according to claim 1, further comprising:

a second flange that extends from a second side edge of at least one of the upper and lower wing pieces, wherein a height of the first flange is lower than a height of the second flange.

* * * * *

UNITED STATES PATENT AND TRADEMARK OFFICE

CERTIFICATE OF CORRECTION

PATENT NO. : 8,800,119 B2
APPLICATION NO. : 13/202629
DATED : August 12, 2014
INVENTOR(S) : Hideki Sato It is certified that error appears in the above-identified patent and that said Letters Patent is hereby corrected as shown below:

In the Specification

In column 5, line 57, delete “form” and insert -- from --, therefor.

In column 10, line 52, delete “form” and insert -- from --, therefor.

In column 14, line 48, before “portion” insert -- a --.

Signed and Sealed this
Eleventh Day of November, 2014

Michelle K. Lee

Michelle K. Lee
*Deputy Director of the United States Patent and Trademark Office*